United States Patent [19]

Rias

[11] Patent Number: 4,799,350

[45] Date of Patent: Jan. 24, 1989

[54] PROCESS FOR PACKAGING PANELS OF A COMPRESSIBLE MATERIAL AND THE PACKAGES PRODUCED BY THIS PROCESS

[75] Inventor: Jean-Claude Rias, Villennes sur Seine, France

[73] Assignee: Isover Saint-Gobain, France

[21] Appl. No.: 403,598

[22] Filed: Jul. 30, 1982

[30] Foreign Application Priority Data

Jul. 31, 1981 [FR] France ..... 81 14970

[51] Int. Cl.[4] ..... B65B 53/02; B65B 63/02

[52] U.S. Cl. ..... 53/399; 53/438; 53/442; 53/447; 53/449

[58] Field of Search ..... 53/399, 436, 438, 442, 53/447, 449, 526; 100/35; 206/83.5, 386, 497, 499, 596

[56] References Cited

U.S. PATENT DOCUMENTS

| | | | |
|---|---|---|---|
| 2,119,956 | 6/1938 | McDonnell | 53/399 |
| 2,780,987 | 2/1957 | Wall | 100/35 |
| 2,874,834 | 2/1959 | Woodward | 206/499 |
| 2,896,207 | 7/1959 | Wilson | 53/438 X |
| 3,231,084 | 1/1966 | Kean | 206/386 |
| 3,246,744 | 4/1966 | Marnon | 53/399 X |
| 3,315,435 | 4/1967 | Gunyou | 53/436 |
| 3,330,089 | 7/1967 | Uematsu | 53/449 X |
| 3,344,784 | 10/1967 | Michels | 53/436 X |
| 3,362,128 | 1/1968 | James | 53/436 |
| 3,499,261 | 3/1970 | Hullhorst et al. | 53/436 |
| 3,537,635 | 11/1970 | Reas | 206/386 |
| 3,541,752 | 11/1970 | Ness | 53/436 |
| 3,874,281 | 4/1975 | Conner et al. | 100/35 |
| 3,895,476 | 7/1975 | Burns | 53/449 X |
| 3,914,918 | 10/1975 | Laird | 53/399 |
| 3,944,070 | 3/1976 | Cardwell et al. | 206/497 X |
| 4,162,603 | 7/1979 | Stromberg | 53/438 |
| 4,265,069 | 5/1981 | Heany | 53/399 |
| 4,318,264 | 3/1982 | Rewitzer | 53/436 |

FOREIGN PATENT DOCUMENTS

| | | | |
|---|---|---|---|
| 866144 | 8/1978 | Belgium . | |
| 2233825 | 1/1973 | Fed. Rep. of Germany | 206/386 |
| 2638921 | 3/1978 | Fed. Rep. of Germany | 100/35 |
| 2221345 | 10/1974 | France | 53/438 |
| 791771 | 7/1979 | France . | |
| 8021735 | 10/1980 | France . | |

*Primary Examiner*—James F. Coan
*Assistant Examiner*—Steven P. Weihrouch
*Attorney, Agent, or Firm*—John T. Synnestvedt; Kenneth P. Synnestvedt

[57] ABSTRACT

The process according to the invention consists of superposing a plurality of panels (1), of providing the pile thus produced with at least one enclosure (2) of shrinkable plastic material, of subjecting the pile to a first compression in a direction normal to its wide surface, of causing the shrinking of the enclosure (2) on the compressed pile to provide a package, of superposing in order of thickness a plurality of identical packages of compressed panels, of applying a flat rigid element (12) against each of the terminal surfaces of the pile of packages thus produced, of subjecting the said pile to a second compression, perpendicular to the flat elements (12) and of joining the pile of packages (5) thus compressed with the aid of assembly means.

The invention is applied to the packaging of panels of compressible materials.

7 Claims, 4 Drawing Sheets

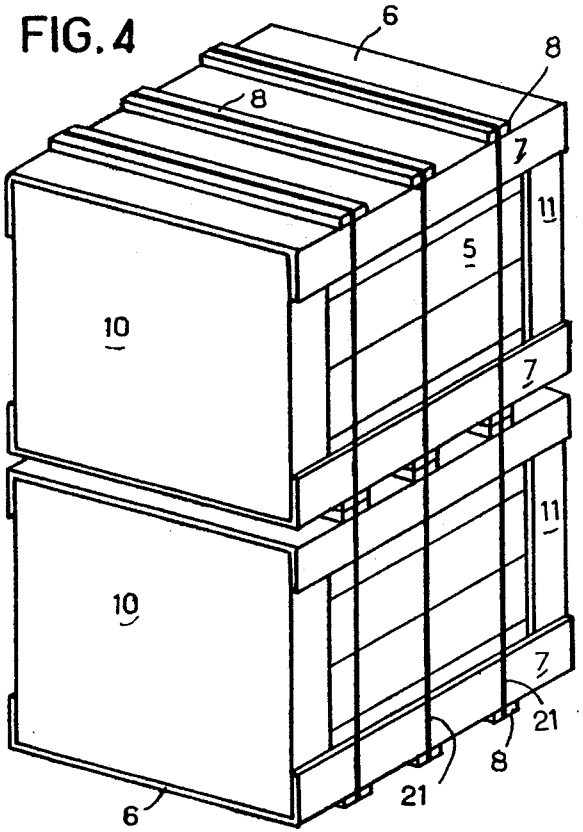
FIG. 4
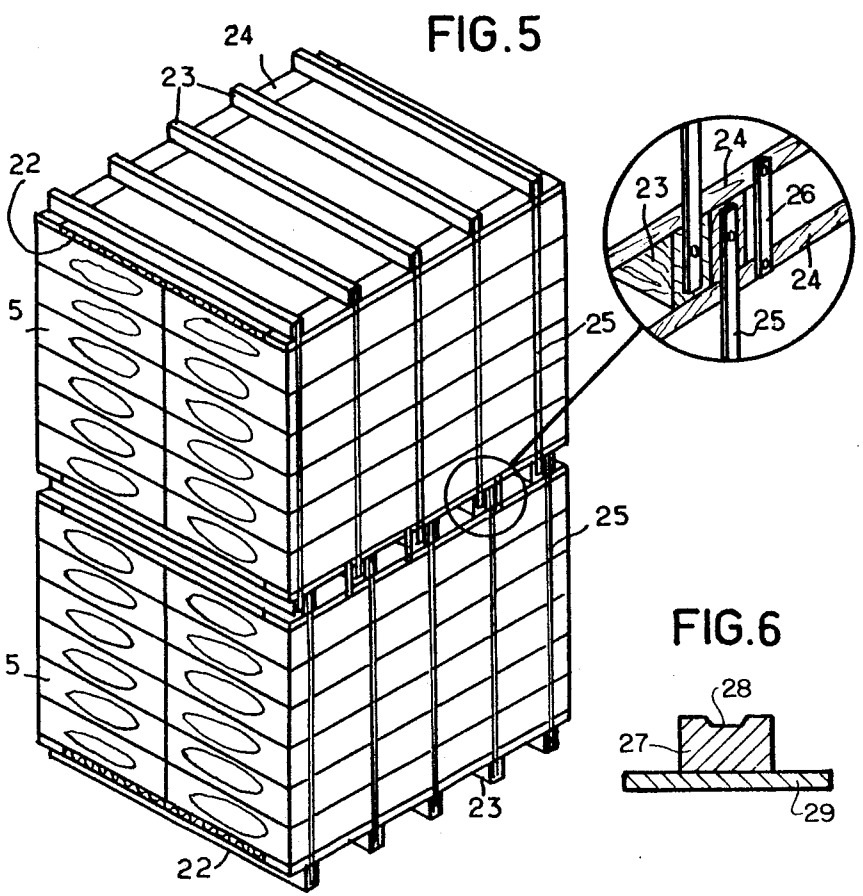
FIG. 5
FIG. 6

PROCESS FOR PACKAGING PANELS OF A COMPRESSIBLE MATERIAL AND THE PACKAGES PRODUCED BY THIS PROCESS

The invention concerns the packaging of panels of a compressible material. More specifically, the object is a process for packaging panels of fibrous materials into one or several separate parcels, said parcels joined into a single unit.

It is this application which will be referred to throughout the present description, however, it will appear clearly to the man of the art that the process according to the invention is equally applicable to any compressible material other than fibrous materials.

It is known that fibrous materials, particularly glass fibers, are frequently supplied to the users in the form of panels or blankets substantially in the shape of a parallelepiped of relatively large dimensions, since its largest dimensions are often on the order of 100×50 cm and its thickness can range from 30 to 200 mm and can even reach 500 mm. These panels can be covered, on one or several of their surfaces, with a sheet material and the panels are themselves joined either in bundles of about ten elementary panels, assembled by a sheath of shrinkable polyurethane or of paper, or in rolls which, themselves, can possibly be packaged in the compressed state by the process described in French patent application No. 79 17771 of July 9, 1979 and in the French application for first certificate of addition No. 80 21735 of Oct. 10, 1980 in the name of SAINT-GOBAIN INDUSTRIES.

Furthermore, from Belgian Pat. No. 866,144, a process is known for packing compressible panels, according to which partial compressions are effected on parcels of superposed panels which are put into a packing envelope.

The delivery to the users of panels in the form of simple bundles leads, however, to a deterioration of the panels thus packaged, and, when the bundle is opened, the panels have lost their initial properties, which is obviously very detrimental to the usage of the product.

However, it is important, in view of the storing by the manufacturer or the user, as well as for handling or transport operations, that the panels are packaged with as low a volume as possible, which implies a significant compression of these panels, yet to an extent compatible with a resumption of satisfactory form, when the compression is discontinued, and without deterioration of their mechancal properties.

The present invention aims to provide a process for packaging panels of a compressible material which responds to these conditions, without presenting the disadvantages of the prior art mentioned above.

In effect, the Applicant has established that if the compression is piecemealed into a least two successive elementary compressions of an individual amplitude lower than the overall extent of compression desired, by maintaining in compression the panels between rigid, flat, parallel elements, it is possible to attain very high degrees of compression (relation of the thickness of a blanket before compression to the thickness after compression) of on the order of 2 to 4, and even 5, without the panels packaged under pressure suffering from the compression operations.

Consequently, the object of the invention is a process for packaging compressible panels characterized by the following successive operations:

a plurality of panels are superposed, vertically or horizontally, in order of their thickness;

the pile thus provided is sheathed with at least one enclosure of shrinkable plastic material;

the pile of panels thus sheathed is subjected to a first compression, perpendicularly to the wide panel faces;

the shrinking of the enclosure on the compressed pile is effected in order to produce a package of compressible panels;

a plurality of identical packages of compressed panels is superposed according to thickness, and possibly in several contiguous piles;

a flat, rigid element is applied against each of the terminal surfaces of the pile of packages thus produced;

the said pile of packages is subjected to a second compression, perpendicularly to the said flat elements; and the pile of packages thus compressed is joined into a single parcel with the aid of assembly means.

According to a particularly economical variation of the process which is well applicable to the packaging of easily compressible panels, the package of compressed panels produced by the first compression is embodied by introducing the pile of panels in the compressed state into a tubular sheath, made particulrly of packaging paper, and the dimensions of which correspond to those of the enclosure of plastic material after having undergone the shrinkage. Next the packages thus obtained are subjected to the second compression and to the assembly as described above in order to achieve the pile of compressed packages.

Possibly, the elementary packages could be subjected to at least one additional compression followed by a complementary shrinkage of the sheath of shrinkable material, before stacking these packages.

The Applicant produced such packages by subjecting a stack of six panels to a compression rate of 1.27, then, after shrinkage of the thermoshrinkable sheath enveloping them, proceeded to an additional compression of the resultant package, at a rate of 1.37, followed by an additional shrinkage of the shrinkable sheath, for example, by heating the sides of this sheath when it is made of a thermoshrinkable material.

Finally, the packages thus produced were superposed to form a pile of six packages which were placed between two rigid plates and compressed at a rate of 2, to be then maintained in the compressed position with assembly means to form a single parcel.

Preferably, the parcel thus produced will then by sheathed by an envelope of shrinkable plastic material which will be subjected to shrinkage.

At least two identical parcels could possibly be stacked on each other, joined by assembly means and possibly sheathed by an additional enclosure of shrinkable material.

The assembly means of the package and the flat elements partially or completely covering the terminal surfaces of the parcel would contain a binding means such as a ribbon of plastic material, so that the unit formed by the said flat elements and the binding means maintains the parcel of packages in a compressed condition and presents enough resistance to the counter-pressure exerted by the package, to avoid deformation of the parcel. The flat elements connected to the top surfaces of the parcel of packages could be formed by a simple flat plate and/or by several parallel panels, made from wood, cardboard or any other material having adequate rigidity. This or these flat element(s) could advantageiously have, on at least two parallel sides, bent surfaces, forming flanges, applied against the lateral surfaces of the pile.

So that the individual parcels which constitute such stacks of packages can be moved with fork lifts, the forks of which would pierce the envelope(s) of thermoshrinkable material in order to engage the parcels at their base, it will be preferable that the rigid mechanical means enclosing each parcel of packages leave passages for the said forks, even when one parcel rests on another similar parcel. For this purpose, beams forming braces will preferably be applied between each binding means and the flat element of the corresponding surface of the parcel. To prevent any displacement of the binding means during handling, the fastened beam will advantageously be provided with a groove to accommodate the binding means. The latter would also be made solid, by nailing or by any other means, to the fastened beam. In the case of at least two similar parcels stacked on top of each other, each parcel could comprise individual binding means, the beams fastened to the bottom surface of a parcel being, in this case, displaced transversely in relation to those fastened to the top surface of the parcel just below. The two subject parcels could also comprise a common binding means passing over the beams of the bottom surface of the parcel placed at the base and over the beams of the top surface of the upper parcel, this latter resting by its bottom beams on the beams of the top surface of the lower parcel.

Furthermore, the beams in question could be fastened to a frame so as to form an actual handling palette.

Of course, means for reinforcement and/or protection of the parcel could be contemplated, for example, plates protecting certain vertical surfaces of the parcel, possibly with flanges applied against the adjoining surfaces, or angle irons placed according to the vertical borders of the parcel, or even braces placed vertically and/or transversely along one or several vertical surfaces of the parcel.

Of course, the invention is not restricted to the packaging process just defined, but it also encompasses the parcels of panels of compressible material produced by this process.

The attached drawings illustrate various forms of implementation of the invention. On these drawings:

FIGS. 1*a* to 1*d* illustrate, in principal, the compression in several successive phases of the panels of compressible material;

FIG. 4 illustrates the stacking of two parcels of the type in FIG. 2, however, comprising common binding means;

FIG. 5 illustrates the stacking of two parcels of another type produced by the process according to the invention;

FIG. 6 is a transverse cross section of a beam having a groove for receiving a binding ribbon;

We will first refer to FIG. 1 which illustrates, in principal, the production of a parcel of compressible panels 1, according to the process of the invention.

The panels 1 are first stacked vertically by thickness (FIG. 1*a*), to form a pile of $x_1$ in height, for example equal to 600 mm.

The pile is next enveloped by a sheath 2 of shrinkable polyethylene and is compressed at a rate of 1.27, its height thus brought to a value $x_2$ equal to 480 mm. The sheath 2 of polyethylene is next shrunk by heating, and a package 3 having an ovoid cross section is thus obtained wherein the sides have a height $y_2$ less than $x_2$ and, for example, equal to 360 mm (FIG. 1*b*).

The package 3 is compressed again with a compression rate of 1.37, which brings the height of the package to a value $x_3$ equal to 350 mm, the sheath 2 again being subjected to shrinkage by heating of its sides. A package 4 of ovoid cross section is thus obtained wherein the sides have a height $y_3$ less than $x_3$ and, for example, equal to 220 mm (FIG. 1*c*).

Figure 1A:
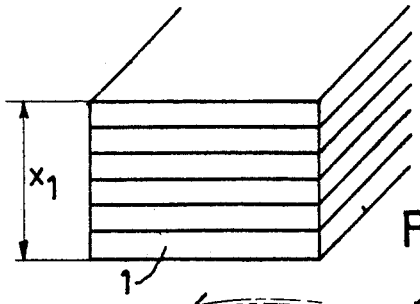
Figure 1B:
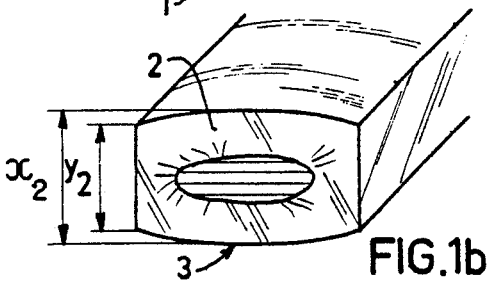
Figure 1C:
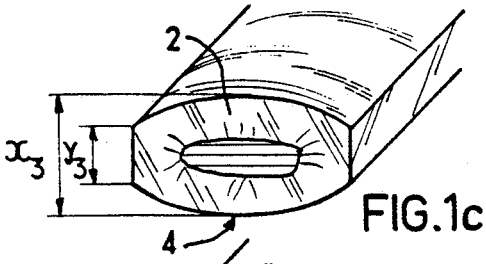

Finally, the packages 4 are stacked on top of each other between two flat rigid plates 12 and are compressed again, in a direction indicated by the arrow $F_1$, which has the effect of restoring to each of the packages the shape of a parallelepiped rectangel 5, similar to the original pile represented in FIG. 1*a*, however, the height $x_4$ of which is equal to 220 mm.

Next, or simultaneous, the compact piles of package 5 thus embodied are joined rigidly by assembly means which will be described below; they are then covered by an enclosure of shrinkable polyethylene, which provides for protection of the compact parcel of packages of panels thus produced.

It should be noted that the panels of each package and/or of each parcel, including those placed at the bottom or at the top of each pile, do not undergo any deterioration due to the piecemeal compressions to which they are subjected and they recover their initial form without permanent deformation, when the user takes apart the parcel thus produced and frees the panels from the sheath 2 which encloses the package.

As was indicated above, numerous assembly means of the packages 5 in the compressed state and the plates 12 (FIG. 1*d*) can be used in the scope of the invention. In the kinds of parcels of packages which will be described below, and which are not restrictive in character, these assembly means are, besides, such that they enable the stacking of two or several like parcels without hindering the handling of the parcels by fork lifts.

Figure 2:
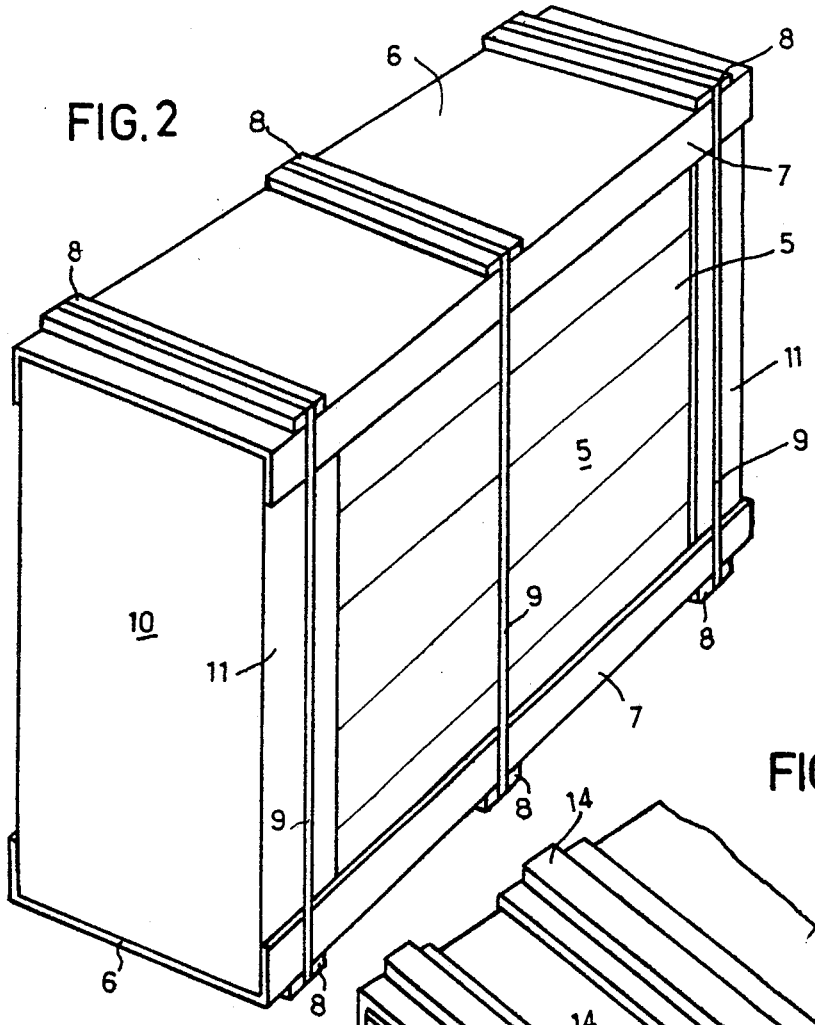
FIG. 2 is a view in perspective of a first type of parcel of panels prepared by the process according to the invention.

In the case of FIG. 2, a cardboard sheet 6 having lateral flanges 7 is placed below the package 5 situated at the bottom of the pile; a similar sheet covers the top package. Beams 8 forming braces are placed on the outer surface of the sheets 6 and plastic bands 9 serving as binding means bear on the beams 8 and enclose the package. Cardboard sheets 10 cover the two parallel end surfaces of the pile of packages, across which the bands 9 do not extend, and these sheets serve as protection for end surfaces. The sheets 10 have flanges 11 extended over the side edges of the stack of packages. Finally, the unit thus produced is enveloped by a sheath of thermoshrinkable polyethylene, to form a compact package which is not too dense and which is easily manipulated by a fork lift, wherein the lifting devices can be easily placed under the packaging, even when the latter is stacked on a similar packaging, as will be seen below.

Figure 3:
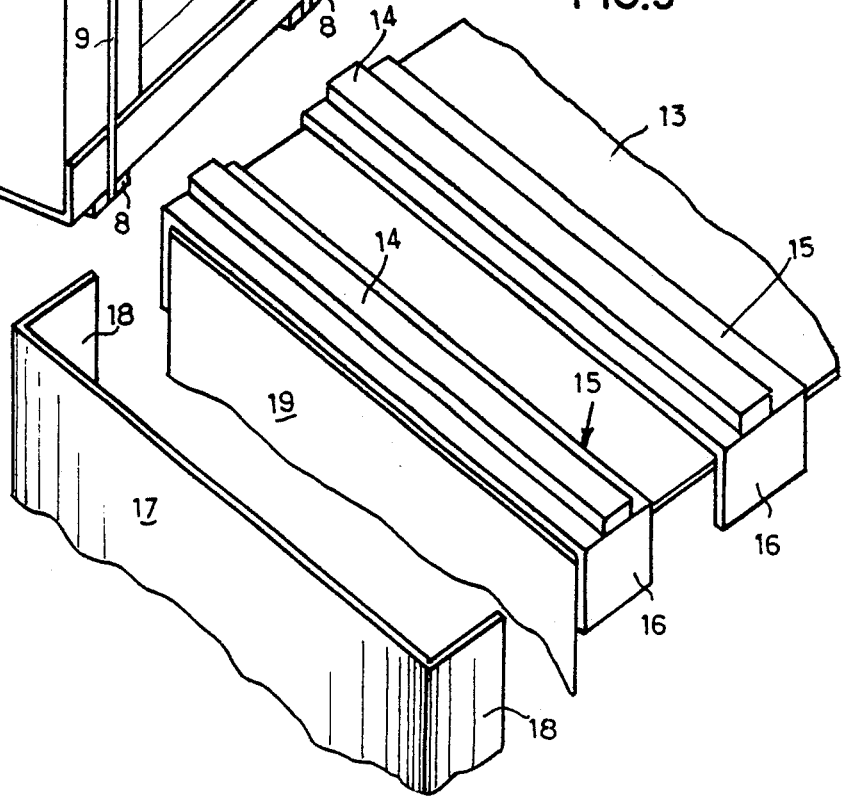
FIG. 3 is a partial view, in broken perspective, showing the constitution of another type of parcel.

In the variation of FIG. 3, a sheet 13 for reinforcement and protection is applied to the top and bottom surfaces of the pile of packages and, between this sheet 13 and the braces 14 for the plastic bands (not shown) pass, individual strips 15 of wood or cardboard are interposed, which strips are equipped with angled end portions 16 overlying the sides of the stack of packages. As in the case of FIG. 2, the two lateral surfaces of the pile of package, across which the plastic bands do not extend, are protected by a sheet 17 equipped with flanges 18, however, a reinforcement sheet 19 is interposed between the sheet 17 and the packages.

FIG. 4, on which the elements already described in relation to FIG. 2 are indicated by the same reference numerals, shows how two subject parcels similar to that of FIG. 2 can be stacked and assembled to form a single package, by resting the braces 8 placed at the bottom of the upper parcel on the braces of the top surface of the parcel lying below, and by substituting common bands 21, which enclose the unit of the pile of parcels, for the individual binding ribbons of each parcel. As before, each individual parcel is sheathed with a shrinkable envelope, and the compact unit formed by the two superposed parcels can, itself, be protected by a shrinkable enclosure.

FIG. 5 illustrates another stacking method of another kind of packaging according to the invention.

In this packaging, a cardboard sheet 22 is applied against the bottom and top surfaces of each parcel and the braces 23 are unitary with a common frame 24, with which they form a sort of palette which is applied against the sheet 22. Metallic bands 25 join the ends of the braces 23 and the attached bands 25 thus forming a binding means for the parcel. The metallic bands 25 are simply nailed to the ends of the braces 23.

The top parcel rests on the top frame 24 of the bottom parcel by its braces 23, which are displaced in relation to the top braces of the bottom parcel. It should be noted that the braces 23 are also staggered in position on their respective frames 24, so that the two stacked parcels are aligned above or below each other. The frames 24 of the two parcels oppositely placed are joined by junction means, for example, by pieces of metallic bands 26 nailed at regular intervals on the two frames.

As is seen on FIG. 6, it is also possible to form a groove 28, to hold the binding ribbon, in the braces 27. It should be noted that, in this variation of the braces, the latter are unitary with a flange 29 by which they come in contact with the packages.

Figure 7:
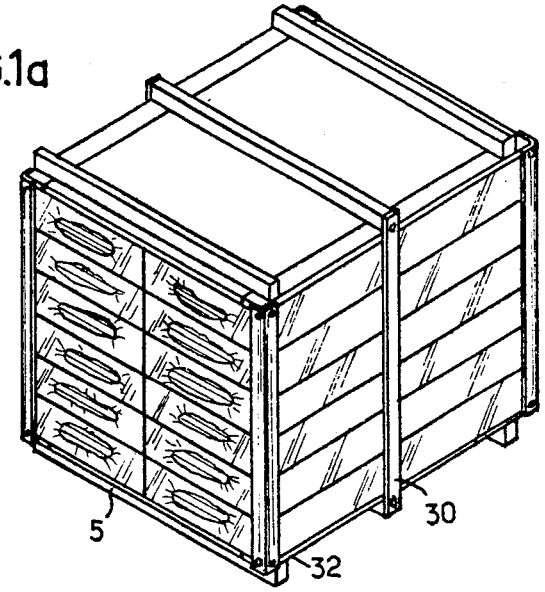
FIG. 7 is a view in perspective of another parcel prepared by the process according to the invention.

In the form of implementation of the invention illustrated by FIG. 7, vertical and/or transverse braces are contemplated on the lateral surfaces of the subject parcels, wherein the vertical borders are protected by angle irons 32.

Figure 1D:
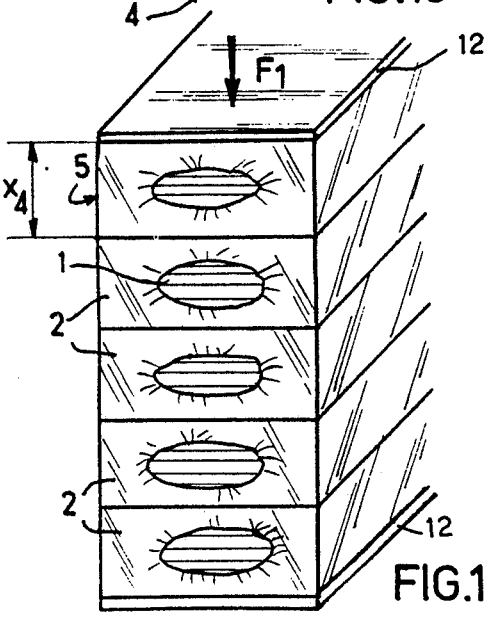
Figure 9:
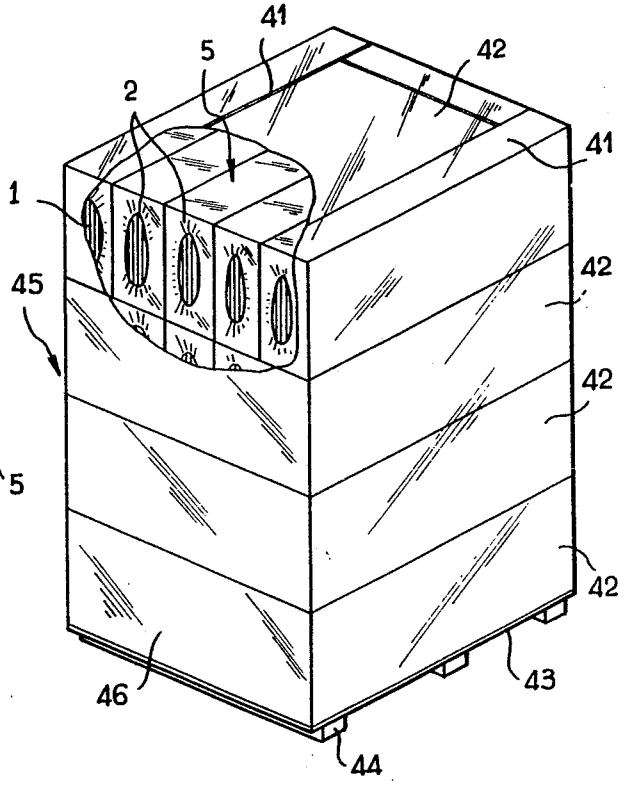
FIG. 9 is a view in perspective, partially stripped, of another parcel prepared according to the process of the invention.
Figure 8:
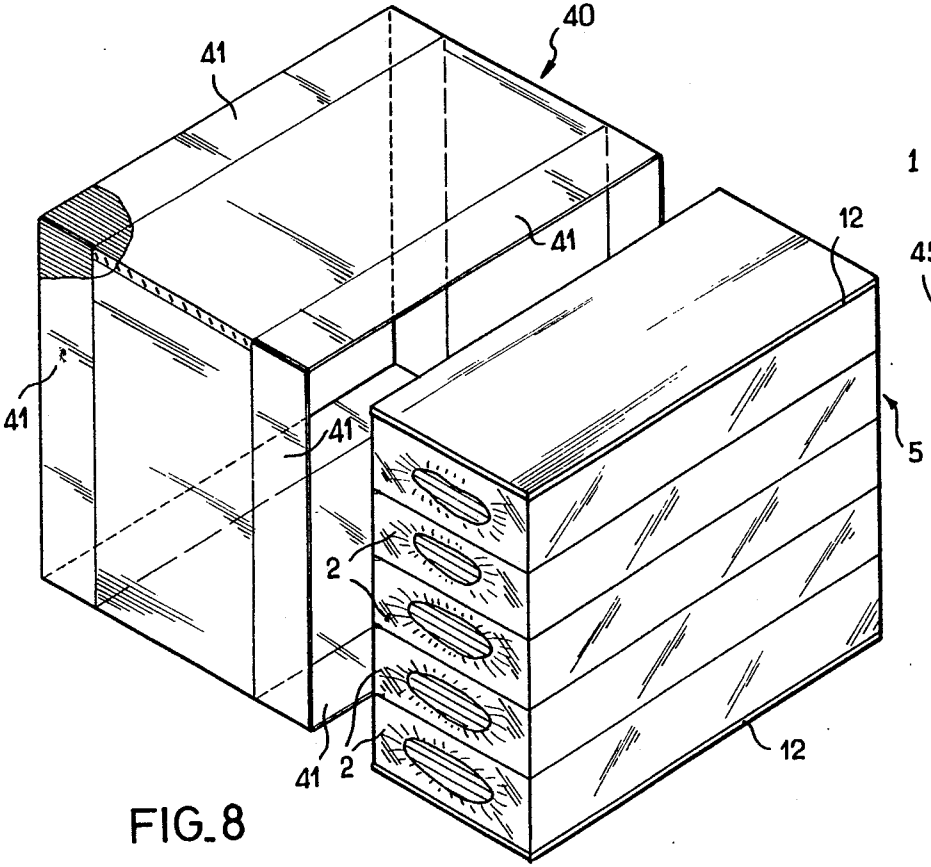
FIG. 8 illustrates another form of embodiment of the process according to the invention.

FIGS. 8 and 9 illustrate another mode of embodiment of the process according to which the assembly means of the compact pile 5 of packages represented in FIG. 1*d* are formed by a packing case, particularly a cardboard case 40 with flanges 41 (FIG. 8). As illustrated by this figure, the pile 5 of packages, compressed between the two flat and rigid plates 12, is introduced edgewise into the case 40 placed, the flanges 41 of the case being in the open position. After placement of the pile 5 in the cardboard box 40, the flanges 41 can be folded up and fixed to one another so as to form a modular parcel 42 (FIG. 9) according to the invention.

As represented in FIG. 9, several of these modular parcels 42 are stacked on top of each other to form the package 45, supported by the platform 43, itself formed, for example, by a cardboard sheet equipped with braces 44 or blocks of wood or polystyrene. It will be seen that the parcels 42 are in contact with each other by their surfaces defined by the folded flanges 41, which implies, according to FIG. 9, that the packages of panels 1 are placed edgewise in the packages 45 and, consequently, that the said panels rest on their edges.

Finally, the assembly of the packages 45 is effected by covering the latter with a polyethylene enclosure 46, which is brought to a temperature sufficient to cause the shrinkage and thereby binding the parcels 42 to each other. In this case it is unnecessary to bind the package obtained, the manufacture of which is thus made more economical.

Among the advantages procured by the mode of embodiment illustrated by FIGS. 8 and 9, the following could be cited:

the construction of the packages 45 is made independent of the filling composition of the modular parcels 42, the height dimension of the packages 45 is very regular and it can be maintained close to 2 cm, which facilitates the placement of the said package in the enclosure, the borders of the modular parcels 42 have good resistance to the stacking; the constraints imposed on the packing for keeping the panels 1 in compression do not exist in the management of the stacking of the parcels 42. In the case of a slackening of this compression due to the accidental deterioration of one or several modular parcels 42, this has the effect of preventing the alteration of the height of the package 45 in its permanence and thereby conserving the capability of easily lifting the latter from the enclosure.

Other modifications can be applied to the packaging process just described and to the parcels of compressible panels embodied by this process without going beyond the scope of the invention.

I claim:

1. Process for packaging compressible panels characterized by the following successive operations:

superposing a plurality of panels to form a pile;

applying an enclosure of shrinkable plastic material to the pile;

subjecting the enclosed pile to a first compression, perpendicularly to the side faces of the panels;

effecting shrinkage of the enclosure on the compressed pile to obtain a package of compressed panels;

stacking a plurality of identical packages of compressed panels in a pile;

applying a flat rigid element against each of the end faces of the pile to form a pile assembly of said elements and stacked packages;

subjecting the pile assembly to a second compression by applying a compression force to the outer sides of and perpendicularly to the planes of said flat rigid elements; and applying package fastening means to the pile assembly of compressed packages and flat rigid elements thereby providing an integrated package assembly incorporating the flat rigid elements at the end faces of the stacked packages.

2. Process according to claim 1, characterized in that, before being stacked, the packages are subjected to a second compression and to a second stage of shrinkage of the plastic enclosure.

3. Process according to either claim 1 or 2, characterized in that said fastening means of the packages comprises binding means joining the flat rigid elements at the end faces of the pile assembly.

4. Process according to claim 3, characterized in that the said flat rigid elements have flanges positioned against the lateral surfaces of the stacked packages.

5. Process according to claim 3, characterized in that beams forming braces are interposed between the said binding means and the flat rigid elements at the end faces of the stacked packages.

6. Process according to claim 1, characterized in that, before placement of said rigid elements against the end faces of the pile of stacked packages, the pile of stacked packages is sheathed with a shrinkable enclosure, the method further including stacking one of such sheathed packages on another of such sheathed packages, and joining such stacked packages together by applying common rigid joining means and thereby form a compact unit.

7. Process according to claim 6, and further including sheathing said compact unit with a shrinkable enclosure, and shrinking said enclosure.

* * * * *

UNITED STATES PATENT AND TRADEMARK OFFICE

CERTIFICATE OF CORRECTION

PATENT NO. : 4,799,350

DATED : January 24, 1989

INVENTOR(S) : Jean-Claude Rias

It is certified that error appears in the above-identified patent and that said Letters Patent is hereby corrected as shown below:

Col. 1, line 56, change "a" to --at--

Col. 2, line 25, change "particulrly" to --particularly--

Col. 2, line 49, change "by" to --be--

Col. 4, line 25, change "rectangel" to --rectangle--

Col. 4, line 28, change "simultaneous" to --simultaneously--

Col. 5, line 5, delete "pass"

Signed and Sealed this

Twentieth Day of February, 1990

*Attest:*

JEFFREY M. SAMUELS

*Attesting Officer* *Acting Commissioner of Patents and Trademarks*